United States Patent [19]

Funakoshi et al.

[11] Patent Number: 4,493,611

[45] Date of Patent: Jan. 15, 1985

[54] HORIZONTALLY SPLIT CASING OF TURBO MACHINE

[75] Inventors: Tadayoshi Funakoshi; Kazuo Takeda, both of Ibaraki, Japan

[73] Assignee: Hitachi, Ltd., Tokyo, Japan

[21] Appl. No.: 437,360

[22] Filed: Oct. 20, 1982

[30] Foreign Application Priority Data

Oct. 23, 1981 [JP] Japan ..... 56/168682

[51] Int. Cl.[3] ..... F01D 25/24

[52] U.S. Cl. ..... 415/199.1; 415/204; 415/219 A

[58] Field of Search ..... 415/204, 206, 207, 219 A, 415/219 B, 199.1

[56] References Cited

U.S. PATENT DOCUMENTS

| | | | |
|---|---|---|---|
| 1,998,754 | 4/1935 | Dorer | 415/204 |
| 2,581,055 | 1/1952 | Wahle | 415/207 |
| 3,143,103 | 8/1964 | Zuhn | 415/199.1 |
| 3,407,995 | 10/1968 | Kinsworthy | 415/204 |
| 3,427,000 | 2/1969 | Scalzo | 415/115 |
| 3,647,314 | 3/1972 | Laessig | 415/206 |

*Primary Examiner*—Edward G. Favors
*Assistant Examiner*—John Kwon
*Attorney, Agent, or Firm*—Antonelli, Terry & Wands

[57] ABSTRACT

A horizontally split casing of a turbo machine, such as a centrifugal compressor, including one half casing formed with scroll grooves on an inner peripheral surface thereof, and the other half casing formed with cutouts in portions thereof corresponding to outlet scrolls. A second casing formed on an inner peripheral surface thereof with scroll grooves is attached to the other half casing in a manner to enclose the cutouts. The horizontally split casing of this construction is low in cost and yet enables a compact size and a light weight to be obtained in a horizontally split casing of a turbo machine.

8 Claims, 14 Drawing Figures

HORIZONTALLY SPLIT CASING OF TURBO MACHINE

BACKGROUND OF THE INVENTION

This invention relates to horizontally split casings of turbo machines each comprising an upper half casing and a lower half casing, and more particularly to a horizontally split casing, adapted to be produced by welding, for a turbo machine, such as a centrifugal compressor or a centrifugal blower of the single-shaft, multiple-stage type.

Heretofore, it has been usual practice to produce casings of centrifugal compressors of the single-shaft, multiple-stage type by casting. The casing produced by casting suffers the disadvantages that it requires a lot of labor for production and the operation is sometimes time-consuming because defective castings are produced.

To overcome these disadvantages of production of casings by casting, it has recently become popular in some applications to rely on welding in place of casting. A casing of the welded structure includes a cylindrical diaphragm support member mounted through supports on the inner side of the cylindrical casing, and outlet scrolls formed between the diaphragm support member and the casing to guide fluid discharge by impellers disposed inwardly of the diaphragm. The casing has high strength because it is a pressure resisting member, and it is a cylindrical structure of uniform diameter to improve weldability to facilitate its production. Some disadvantages are associated with the casing of the welded structure described hereinabove. They are as follows:

(a) As noted above, the casing is a cylindrical member of uniform diameter located outside the scrolls and having high strength and improved weldability so that it is easy to produce. Because of this construction, the diameter of the casing becomes too large and its weight becomes heavy. As a result, production steps including welding steps increase in number, and production costs also increase, so that the casting becomes very expensive.

(b) The increase in the weight of the casing increases the weight of compressor or the like, thereby making it necessary to increase the ability of other peripheral equipment, for example, a maintenance crane. This inevitably raises costs of basic structures.

(c) In a turbo machine, efficiency can be improved by causing a change in the area of the scrolls to take place smoothly in going toward the inlet nozzle. However, when the casing is of the welded structure, it is quite difficult to provide this construction.

SUMMARY OF THE INVENTION

An object of this invention is to provide a horizontally split casing of a turbo machine which is easy to produce, compact in size and light in weight whereby production costs can be reduced.

Another object is to provide a horizontally split casing of a turbo machine which is capable of providing the outlet scrolls of the horizontally split casing with a channel area large enough to assure efficient operation of the turbo machine.

To accomplish the above noted objects, the invention provides, in a horizontally split casing of a turbo machine comprising an upper half casing, a lower half casing and an outlet nozzle mounted at the upper half casing or the lower half casing, wherein the upper and lower half casings are formed with axially extending flanges for connecting them together, scroll grooves formed in one of the upper and lower half casings for providing outlet scrolls on an inner surface of the half casing, cutouts formed in the other half casing in portions corresponding to the outlet scrolls, and a second casing attached to an outer peripheral surface of the other half casing in a manner to enclose the cutouts, the second casing being formed with scroll grooves on an inner peripheral surface thereof which scroll grooves being connected at one end to the scroll grooves formed in the one half casing and at the other end to the outlet nozzle.

Additional and other objects, features and advantages of the invention will become apparent from the description set forth hereinafter when considered in conjunction with the accompanying drawings.

DESCRIPTION OF THE PREFERRED EMBODIMENTS

To obtain a compact size and a light weight casing requires minimization of the casing diameter. The outlet scrolls of a turbo machine have an area which is not the same through the entire periphery but gradually increases in going toward the outlet nozzle. The present invention has been developed based on this fact. According to the invention, scroll grooves are formed on an inner peripheral surface of one of upper and lower half casings in portions of the casing in which the scrolls may have a small cross sectional area to provide the outlet scrolls, and a second casing is provided to form scroll grooves thereon to increase the area of the outlet scrolls on a side near the outlet nozzle.

Figure 1:
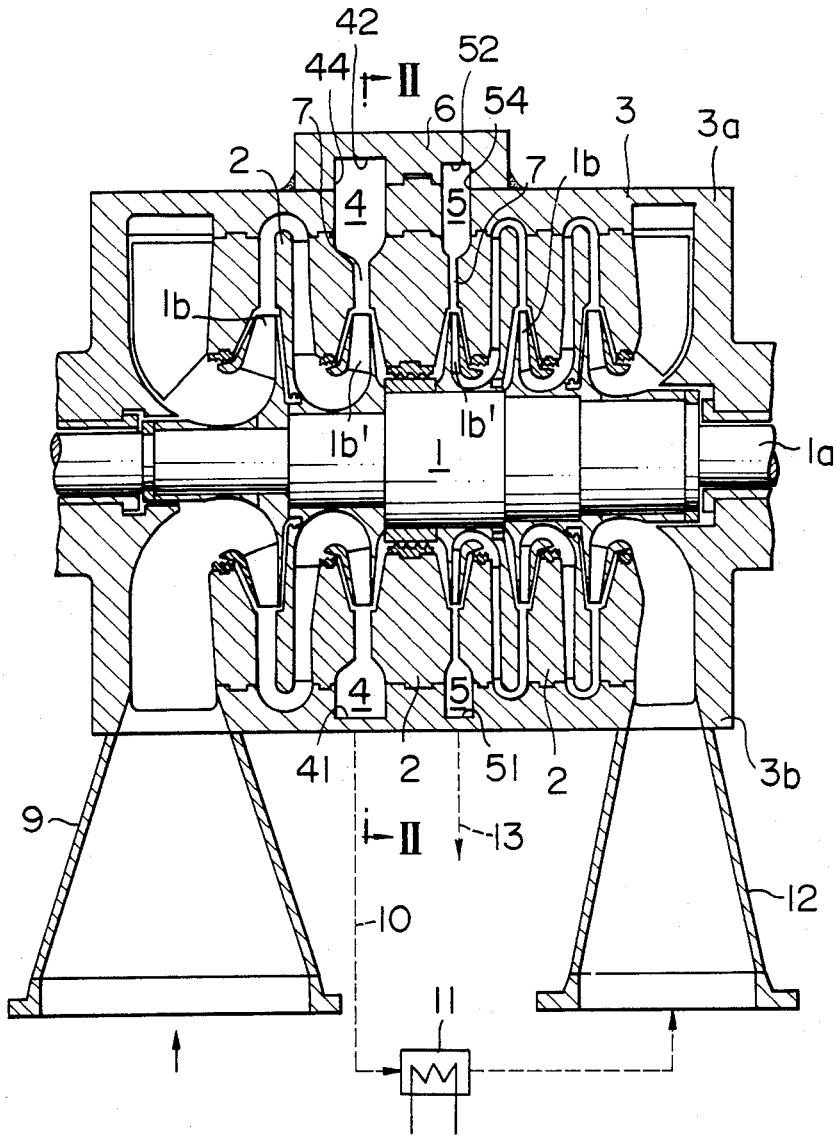
FIG. 1 is a vertical sectional view of a centrifugal compressor of the single-shaft, multiple-stage type provided with a horizontally split casing comprising one embodiment of the invention.
Figure 2:
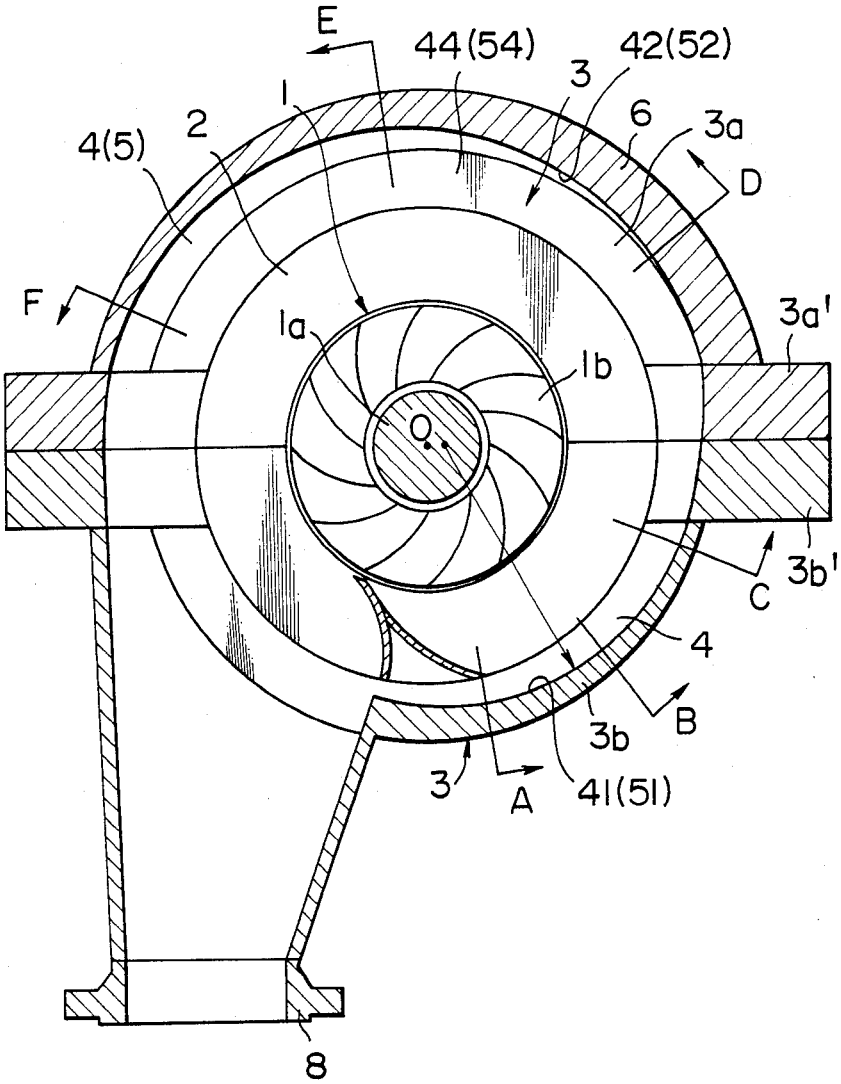
FIG. 2 is a sectional view taken along the line II—II in FIG. 1.

Referring now to the drawings wherein like reference numerals are used throughout the various views to designate like parts and, more particularly, to FIGS. 1–4, according to these figures, a centrifugal compressor of a single-shaft multiple stage type includes rotor 1 comprising a plurality of impellers 1*b* arranged in back-to-back relation and supported on a rotary shaft 1*a*. Diaphragms 2 are arranged around the impellers 1*b* for regulating and guiding an inflow into and an outflow of gas from the impellers 1*b*. A horizontally split casing 3, constructed in a manner to withstand the internal pressure supports the rotor 1 for rotation and fixes the diaphragms 3 in place. The horizontally split casing 3 includes an upper half casing 3*a* and a lower half casing 3*b* rigidly connected together by bolts, not shown, at flanges 3*a*′ and 3*b*′ formed in the upper and lower half casings 3*a* and 3*b*, respectively, and extending axially as shown in FIG. 2. Of the upper and lower half casings 3*a* and 3*b*, one half casing 3*b* is formed on an inner peripheral surface thereof with scroll grooves 41 and 51 for forming outlet scrolls 4 and 5, and the other half casing 3*a* is formed with peripherally extending cutouts 44 and 54 in positions thereof corresponding to the outlet scrolls 4 and 5. A second casing 6 of a hemispherical form is joined, as by welding, to an outer peripheral surface of the other half casing 3*a* in a manner to enclose the cutouts 44 and 54. The second casing 6 is formed on an inner peripheral surface thereof with scroll grooves 42 and 52 for forming the outlet scrolls 4 and 5, so as to thereby reduce the depth of the grooves of the scrolls 4 and 5 while increasing the area of the channels therethrough. The scroll grooves 42 and 52 are connected at one end thereof to the scroll grooves 41 and 51 and at the other end thereof to an outlet nozzle located at the one half casing 3*b*. A diffuser 7 located on an outer side of the last stage impeller 1*b*′ has its length reduced so as to form the outlet scrolls 4 and 5 directly on an outer side of the diffuser 7.

As shown, the outlet scrolls 4 and 5 are defined on the upper half casing 3*a* side by the diaphragms 2, the cutouts 44 and 54 of the casing 3 and the scroll grooves 42 and 52 formed on the inner peripheral surface of the second casing 6 and on the lower half casing 3*b* side by the scroll grooves 41 and 51 formed on the inner peripheral surface of the casing 3 and the diaphragms 2. The scroll grooves 41, 51, 42 and 52 are formed such that the distance between outer peripheral surfaces of the outlet scrolls 4 and 5 and the center 0 of the casing 3 successively becomes larger in going toward the outlet nozzle 8 located at the lower half casing 3*b*, so that the outlet scrolls 4 and 5 can have their cross-sectional area successively increased in going toward the outlet nozzle 8.

Figure 3A:
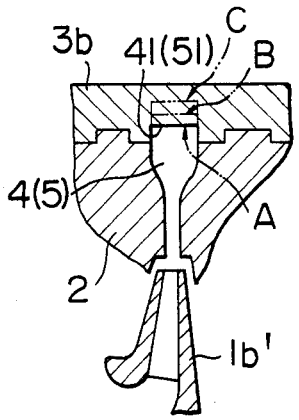
FIG. 3A is a sectional view taken along the line A–C in FIG. 2.
Figure 3B:
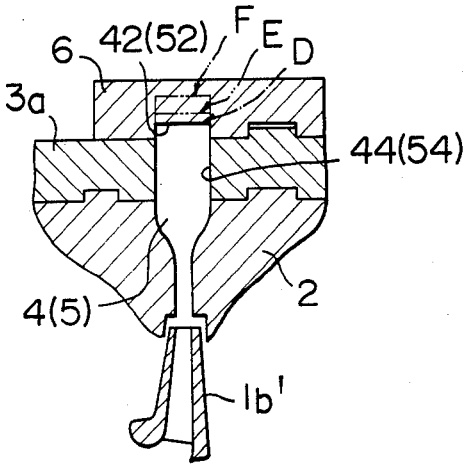
FIG. 3B is a sectional view taken along the line D–F in FIG. 2.

FIGS. 3A and 3B more clearly depict a change in the cross-sectional area of the outlet scrolls 4 and 5. More particularly, FIG. 3A shows a change in the cross-sectional area of the outlet scrolls on the side of the lower half casing 3*b* in which the scroll groove 41 is shown as being formed in such a manner that portions A remotest from the outlet nozzle 8 has the smallest cross-sectional area and portions B and C have their cross-sectional areas successively increased. FIG. 3B shows a change in the cross-sectional area of the outlet scrolls on the side of the upper half casing 3*a* in which the cutout 44 is formed in a portion of the upper half casing 3*a* corresponding to the width of the scrolls to thereby increase the cross-sectional area, with the depth of the scroll groove 42 being gradually increased in going to portions D, E and F to increase the cross-sectional areas of the outlet scrolls successively in going toward the outlet nozzle 8. By successively increasing the cross-sectional areas of the outlet scrolls 4 and 5 in going toward the outlet nozzle 8, it is possible to render the flow velocity of gas discharged from the final stage impeller 1*b*′ substantially uniform in the outlet scrolls 4 and 5.

FIGS. 2 and 3 only shows the outlet scroll 4. The outlet scroll 5 is similar in construction to the outlet scroll, so that the description of the construction thereof will be omitted.

Figure 4A:
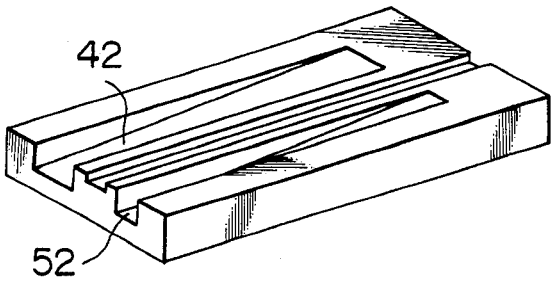
FIGS. 4A and 4B show one example of production of the second casing shown in FIGS. 1–3.
Figure 4B:
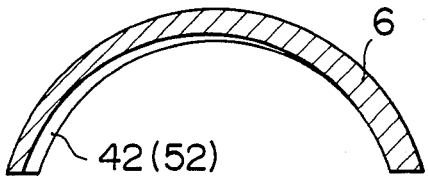

In producing the second casing 6, as shown in FIG. 4*a*, the scroll grooves 42 and 52 are first formed in inclined positions on flat plate as and then, as shown in FIG. 4*b*, are bent into a hemispherical form to bring the same into intimate contact with an outer peripheral surface of the casing 3. Thus, it is possible to readily produce the scroll grooves 42 and 52 varying in depth in a peripheral direction. By attaching the second casing 6 produced in this way to the half casing 3*a* (or 3*b*) having no outlet nozzle 8, it is possible to readily produce the horizontally split casing according to the invention.

Flow of the gas handled by a compressor of the single-shaft, multiple-stage type provided with the horizontally split casing according to the invention will be described by again referring to FIG. 1. The gas is down by suction through a suction nozzle 9 and has its pressure raised by the impellers 1*b* and 1*b*′ of the lower pressure side arranged in two stages. Then the gas flows from the diffuser 7 through the outlet scroll 4, and from the outlet nozzle 8 through a line 10 until it is led out of the casing 3. After being cooled by a cooler 11 mounted in the line 10, the gas is drawn by suction through a suction nozzle 12 of the higher pressure side. The gas has its pressure further raised by the impellers 1*b* and 1*b*′ of the higher pressure side arranged in three stages, the gas flows through the diffuser 7 and outlet scroll 5 and is discharged through an outlet nozzle, not shown, into a discharge line 13 to be delivered to the next following station where it is needed.

In the embodiment shown and described hereinabove, the second casing 6 has only to be attached to an outlet scroll portion of one half casing. This reduces the area to be welded and facilitates production of the horizontally split casing, and enables a compact size and a light weight to be obtained in a horizontally split casing which is low in expenses.

Figure 5:
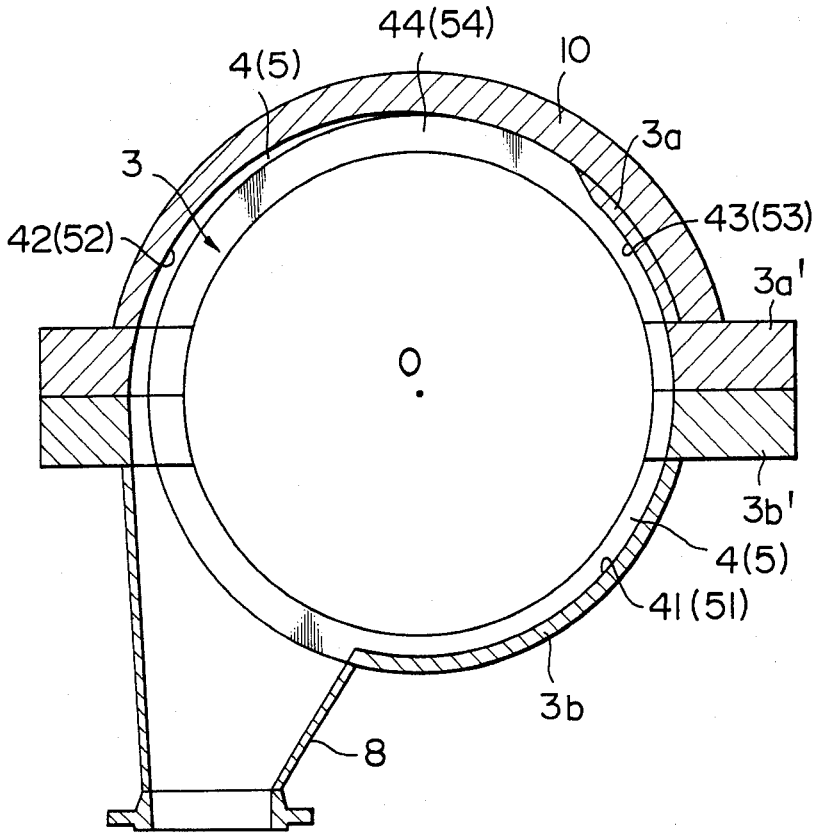
FIG. 5 is a transverse sectional view of the outlet scroll portion of the horizontally split casing comprising a second embodiment of the invention.

As shown in FIG. 5, the scroll grooves 41 and 51, formed on an inner peripheral surface of one half casing 3*b* formed with the outlet nozzle 8, have a constant depth, and the scroll grooves 43 and 53 are formed in a portion of an inner surface of the other half casing 3*a* having no outlet nozzle 8. The construction of this embodiment is similar to that of the first embodiment shown in FIGS. 1–4 in other respects. In this embodiment, the outlet scrolls 4 and each have a portion in which the cross-sectional area is constant as viewed peripherally. Although efficiency is slightly reduced in operation, the embodiment of FIG. 5 offers the additional advantages of being easy to produce and low in cost.

Figure 6:
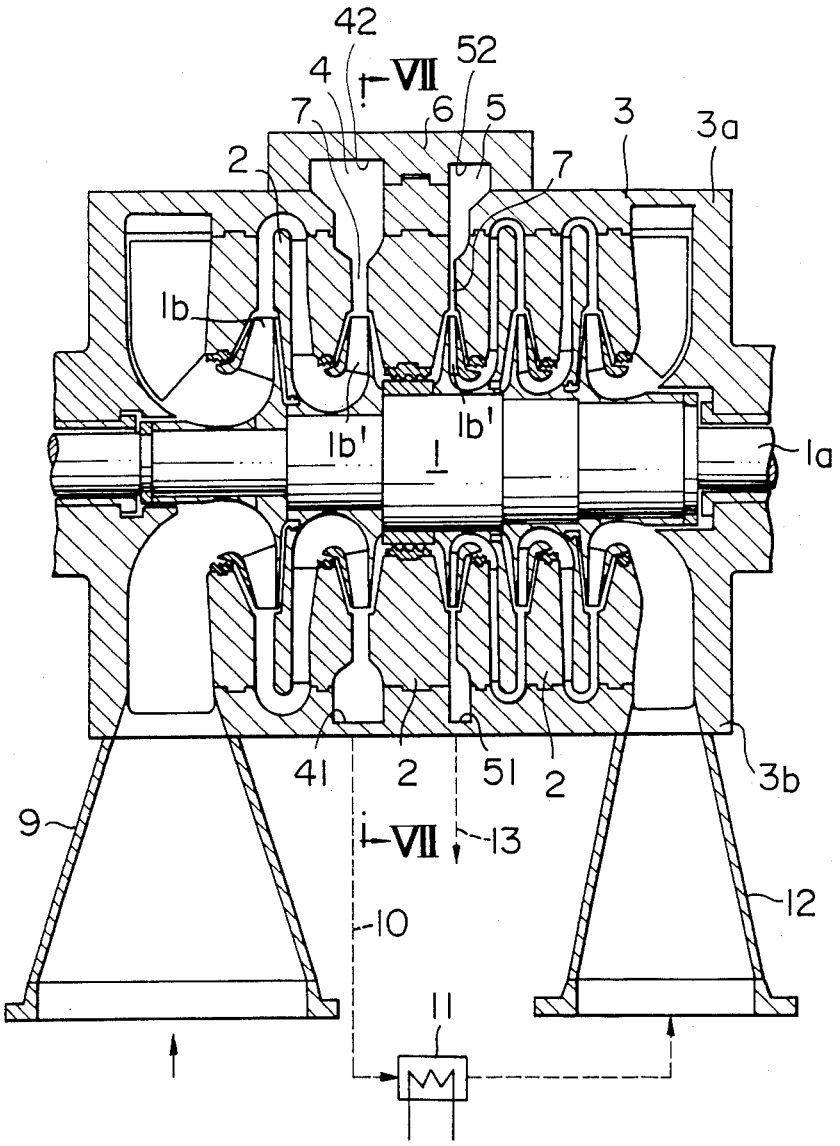
FIG. 6 is a vertical sectional view of a centrifugal compressor of the single-shaft, multiple-stage type provided with the horizontally split casing comprising a third embodiment of the invention.

In FIG. 6, to increase the area of channel of the outlet scrolls 4 and 5 over and above that in the embodiments of FIGS. 1–5, the scroll grooves 42 and 52, formed at the second casing 6, each have a width greater than those of the scroll grooves 41 and 51 formed on the inner surface of the lower half casing 3*b*. More specifically, the scroll groove 42 has a width greater than that of the scroll groove 41, and the scroll groove 52 has a width greater than that of the scroll groove 51.

Figure 7:
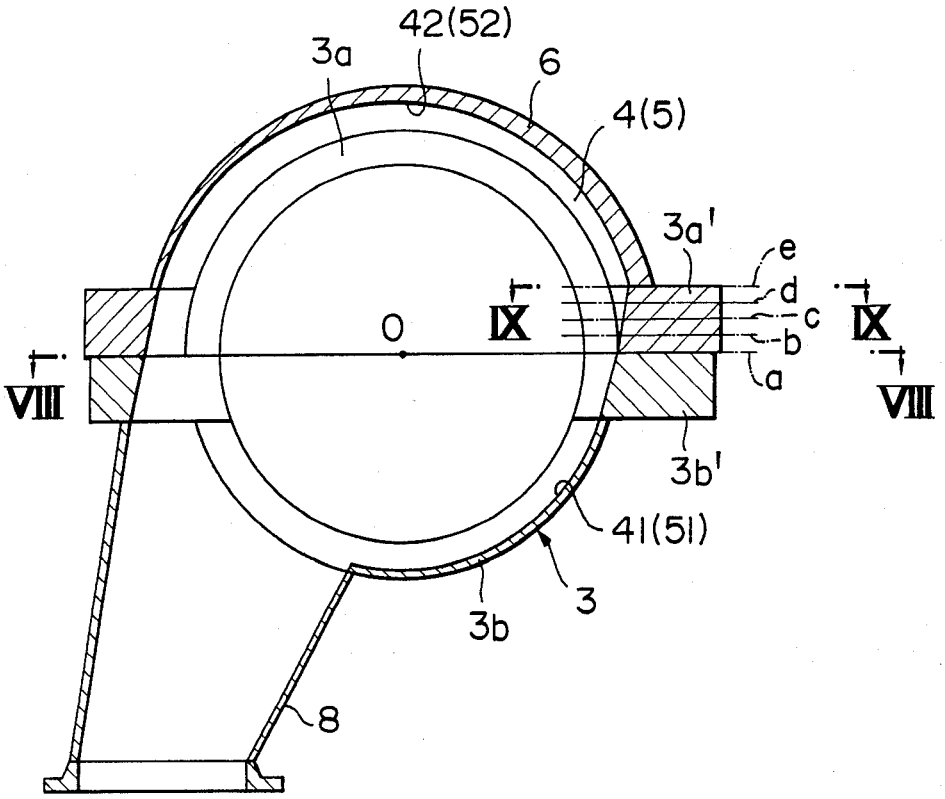
FIG. 7 is a sectional view of the horizontally split casing taken along the line VII—VII in FIG. 6.
Figure 8:
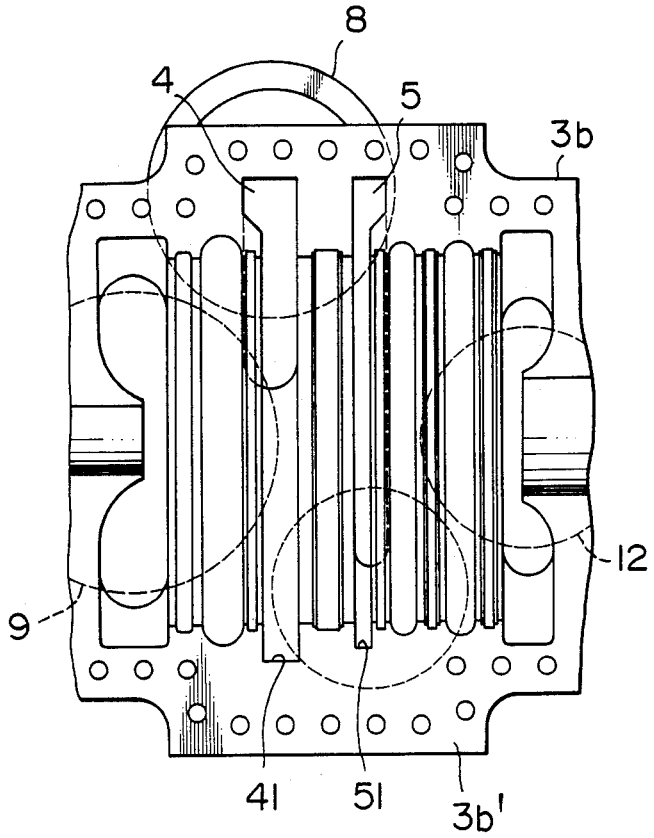
FIG. 8 is a sectional view taken along the line VIII—VIII in FIG. 7.
Figure 9:
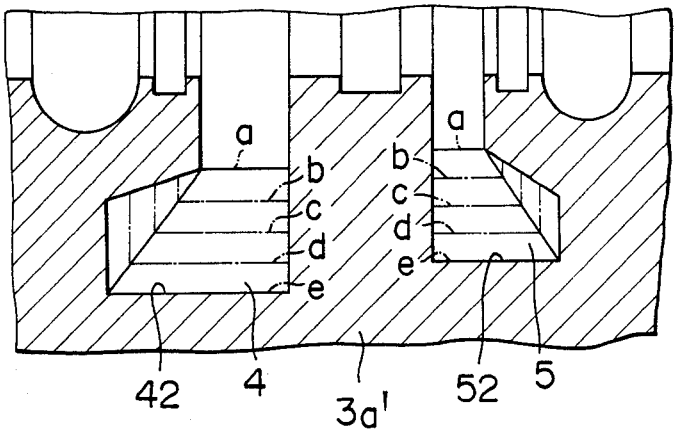
FIG. 9 is a sectional view taken along the line IX—IX in FIG. 7.

The distance between the outer peripheral surface of the scroll grooves 42 and 52 formed at the second casing 6 and the center 0 of the casing 3 is greater than the distance between the outer peripheral surfaces of the scroll grooves 41 and 51 formed at the lower half casing 3*b* and the center 0 of the casing 3. Thus, in the embodiment of FIG. 6, the outlet scrolls 4 and 5 each have a groove depth and a groove width which are larger on the upper half casing 3*a* side than on the lower half casing 3*b* side. This makes it necessary to provide a smooth connection at a flange section 3*a*' between the scroll grooves 41 and 42 and 51 and 52 respectively as shown in FIG. 7. The shape of the channel through the outlet scrolls 4 and 5 at the flange section 3*a*' will be described by referring to FIGS. 7 and 9. Solid lines and dash-and-dot lines a–e in FIG. 9 indicate the shape of the outlet scrolls 4 and 5 of portions a–e shown in FIG. 6. In this embodiment, the scroll grooves 42 and 52 are formed in the flange section 3*a*' in such a manner that their depth and width successively increase in going toward the outlet nozzle 8, so that a smooth connection can be provided at the flange section 3*a*' between the scroll grooves 41 and 51 formed at the lower half casing 3*b* and the scroll grooves 42 and 52 formed at the second casing 6.

In this embodiment, the scroll grooves 41 and 51 formed at the lower half casing 3*b* each have a constant depth, but the scroll grooves 42 and 52 formed at the second casing 6 each have a depth which, as in the the embodiment of FIGS. 1–4, successively becomes larger in going from the flange section 3*a*' toward the outlet nozzle 8. That is, the scroll grooves 42 and 52 are formed such that, as shown in FIG. 7, the distance between the outer peripheral surfaces of the outlet scrolls 4 and 5 and the center 0 of the casing 3 successively increases in going toward the outlet nozzle 8. This makes is possible to render the flow velocity of the gas discharged from the last stage impeller 1*b*' substantially uniform in the outlet nozzle 8.

Figure 10:
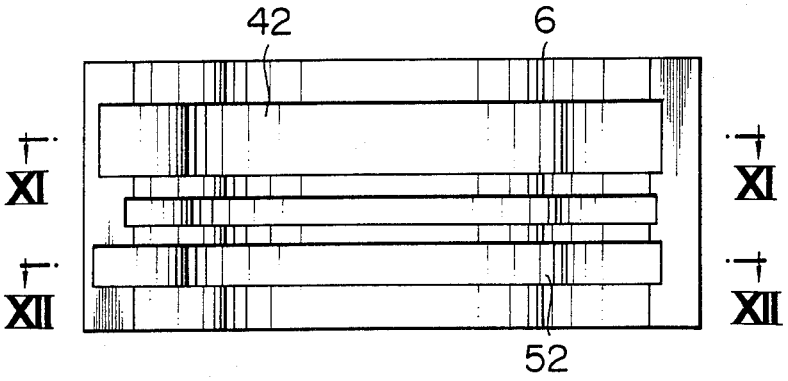
FIG. 10 is a bottom plan view of the second casing shown in FIG. 7.
Figure 11:
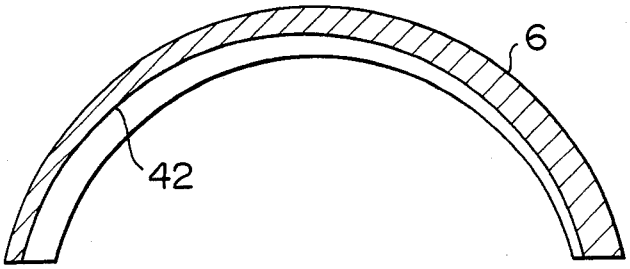
FIGS. 11 and 12 are sectional views respectively taken along the lines XI—XI and XII—XII in FIG. 10.
Figure 12:
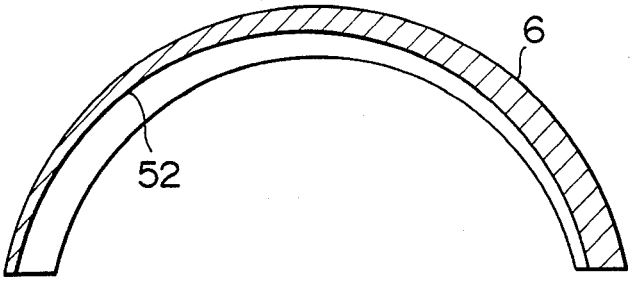

FIGS. 10–12 show in detail the shape of the scroll grooves 42 and 52 formed at the second casing 6. The second casing 6 can be readily produced, as in the first embodiment, by forming the scroll grooves 42 and 52 on a flat plate which is then bent into a hemispherical form to be brought into intimate contact with the outer peripheral surface of the upper half casing 3*a*. By joining the second casing 6 produced in this way to the upper half casing 3*a* by welding, it is possible to readily produce the horizontally split casing according to the invention. When the second casing 6 is produced by bending a flat plate, the thickness of the second casing 6 is limited to that of the plate capable of being bent. This makes it difficult to obtain a large depth in the scroll grooves 42 and 52. However, since no limits are placed on the width of the second casing 6, it is possible to select any value as desired for the width of the scroll grooves 42 and 52. Thus, it is possible to freely select any value as desired for the area of the channel through the outlet scrolls 4 and 5 to achieve high efficiency without greatly increasing the thickness of the second casing 6.

In the embodiment shown and described hereinabove, the scroll grooves 42 and 52 formed at the second casing 6 have a constant width. However, the scroll grooves 42 and 52 may have a width which successively increases in going toward the outlet nozzle 8 from the flange section 3*a*'. Also in this embodiment, the scroll grooves 41 and 51, formed at the lower half casing 3*b* have a constant depth, but their depth may, as in the embodiment of FIGS. 1–4, be successively increased in going toward the outlet nozzle 8 from the flange section 3*a*'.

The embodiment of FIG. 6 is capable of achieving the same effects as the embodiments FIGS. 1–5. In the embodiment of FIG. 6, the outlet scrolls formed at the second casing 6 can have their width increased, and this makes it possible to freely select an area for the channel through the outlet scrolls 4 and 5 without increasing the thickness of the second casing 6 greatly. This is conducive to improvements in the efficiency of a turbo machine and facilitates bending of a flat plate when the second casing is formed by bending the flat plate.

From the foregoing description, it will be appreciated that in the horizontally split casing according to the invention, the outlet scrolls are formed on the inner peripheral surface of the casing in portions in which the outlet scrolls need not have a large cross-sectional area, and a second casing is provided to a portion in which the outlet scrolls should have a large cross-sectional area to form outlet scrolls on the inner peripheral surface of the second casing. Thus, the second casing has only to be located in a portion of one half casing where the outlet scrolls are formed. By this arrangement, production is facilitated on account of a reduction in parts requiring welding and a compact size and a light weight can be obtained in a horizontally split casing, to thereby reduce cost. In addition, by increasing the width of the scroll grooves formed at the second casing as is the case with the embodiment of FIG. 6, it is possible to increase the area of the channel through the outlet scrolls.

It has been ascertained that in the horizontally split casing according to the invention, the outer diameter, the weight and the number of welding steps can be reduced by about 25%, 40% and 40%, respectively, as compared with casings of the welded structure of the prior art. This means that cost can be greatly reduced by the invention.

In the embodiments described hereinabove, the second casing 6 is attached to the upper half casing 6. It is to be understood, however, that the invention is not limited to this specific position of the second casing 6 and that the second casing 6 may be attached to the lower half casing 3*b* depending on the position of the outlet nozzle 8 when the latter is formed at the upper half casing 3*a*.

Also, the invention can have application not only in centrifugal compressors of the single-shaft, multiple-stage type wherein a plurality of impellers are arranged in back-to-back relation at a plurality of stages but also in other types of turbo machine, such as centrifugal compressors of the single stage and centrifugal compressors of the single-shaft, multiple-stage type wherein a plurality of impellers are arranged in an orderly manner. However, when the invention is applied to centrifugal compressors of the single-shaft, multiple-stage type wherein a plurality of impellers are arranged in back-to-back relation at a plurality of stages as is the case with the embodiments shown and described hereinabove, it is possible to simultaneously form two outlet scrolls on the inner peripheral surface of the single second casing and the mounting of the second casing is facilitated because the two outlet scrolls are located close to each other substantially in the central portaon of the casing.

What is claimed is:

1. A horizontally split casing of a turbo machine including a plurality of impellers arranged axially of a rotary shaft in a back-to-back relationship in order to provide two sets of compression stages whereby a fluid discharged from a last stage of one set of compression stages is introduced into a first stage of the other set of compression stages and the fluid is discharged from a last stage of the other set of compression stages, a common diaphragm means for the impellers of the last stages of the two sets of compression stages, and defuser means provided for each of the last stage impellers of the two sets of compression stages holding the diaphragm therebetween, an upper half casing of a welded construction, a lower half casing of a welded contrustion, axially extending flanges formed on said upper half casing and said lower casing for enabling the casings to be connected together, outlet nozzles respectively located at said upper half casing and said lower half casing, scroll grooves located at one of said upper half casing and said lower half casing in such a manner so as to be connected to said diffusers of said two sets of compression stages for providing outlet scrolls, cutouts formed in portions of the other half casing corresponding to the outlet scrolls, a second casing attached to an outer peripheral surface of the other half casing in a manner to enclose said cutouts, and further scroll grooves formed on an inner peripheral surface of said second casing, said further scroll grooves being connected at one end thereof to said scroll groove formed in said one half casing and at the other end thereof to said outlet nozzles, and wherein said further scroll grooves are constructed such that a depth thereof gradually increases in a direction toward said outlet nozzles.

2. A horizontally split casing of a turbo machine as claimed in claim 1, wherein said scroll grooves formed on the inner surface of said one half casing are constructed such that the depth thereof also successively increases in going toward said outlet nozzle.

3. A horizontally split casing of a turbo machine comprising an upper half casing, a lower half casing, said upper half casing and said lower half casing being connected together at axially extending flanges formed therein; and an outlet nozzle located at one of said upper half casing and said lower half casing, wherein the improvement comprises:

scroll grooves formed on an inner surface of one of said upper half casing and said lower half casing for providing outlet scrolls;

cutouts formed in portions of said the other half casing corresponding to the outlet scrolls;

a second casing attached to an outer peripheral surface of said the other half casing in a manner to enclose said cutouts;

scroll grooves formed on an inner peripheral surface of said second casing, said scroll grooves being connected at one end thereof to said scroll grooves formed in said one half casing and at the other end thereof to said outlet nozzle, said scroll grooves formed at said second casing are constructed such that the depth thereof successively increases in going toward said outlet nozzle; and a flat plate formed with scroll grooves in inclined positions is bent into a hemispherical form and attached to one of said upper half casing and said lower half casing.

4. A horizontally split casing of a turbo machine as claimed in claim 1, wherein said further scroll grooves formed on the inner peripheral surface of said second casing have a width greater than that of the scroll grooves formed on the inner surface of said one half casing.

5. A horizontally split casing of a turbo machine as claimed in claim 4, wherein the scroll grooves formed in a flange section have a width and dept successively increasing in a direction of said outlet nozzles, and wherein the scroll grooves formed on the inner surface of said one-half casing and the scroll grooves formed on the inner peripheral surface of said second casing are smoothly connected together at said flange section.

6. A horizontally split casing of a turbo machine as claimed in claim 5, wherein said upper half casing and said lower half casing are connected together by bolts at the axially extending flanges formed therein, and wherein said second casing is joined by welding to an outer peripheral surface of the other half casing.

7. A horizontally split casing of a turbo machine as claimed in claim 3, wherein said turbo machine comprises a centrifugal compressor of the single-shaft, multiple-stage type comprising a plurality of impellers located axially of the same rotary shaft.

8. A horizontally split casing of a turbo machine as claimed in claim 7, wherein said plurality of impellers located axially of the same rotary shaft are arranged in back-to-back relation.

* * * * *